US005619852A

United States Patent [19]

Uchikawa

[11] Patent Number: 5,619,852

[45] Date of Patent: Apr. 15, 1997

[54] AIR/FUEL RATIO CONTROL SYSTEM FOR INTERNAL COMBUSTION ENGINE

[75] Inventor: Akira Uchikawa, Atsugi, Japan

[73] Assignee: Unisia Jecs Corporation, Atsugi, Japan

[21] Appl. No.: 499,689

[22] Filed: Jul. 7, 1995

[30] Foreign Application Priority Data

Jul. 8, 1994 [JP] Japan ..... 6-157246

[51] Int. Cl.[6] ..... F01N 3/28

[52] U.S. Cl. ..... 60/276; 60/285; 123/696

[58] Field of Search ..... 60/276, 285; 123/696

[56] References Cited

U.S. PATENT DOCUMENTS

| | | | |
|---|---|---|---|
| 3,990,411 | 11/1976 | Toelle | 123/696 |
| 4,224,910 | 9/1980 | O'Brien | 123/696 |
| 4,748,953 | 6/1988 | Osuga | 123/696 |
| 5,144,915 | 9/1992 | Grabs | 123/696 |
| 5,207,056 | 5/1993 | Benninger | 60/276 |
| 5,239,975 | 8/1993 | Mallebrein | 123/696 |

FOREIGN PATENT DOCUMENTS

| | | |
|---|---|---|
| 58-48756 | 3/1983 | Japan . |
| 60-240840 | 11/1985 | Japan . |

*Primary Examiner*—Douglas Hart
*Attorney, Agent, or Firm*—Foley & Lardner

[57] ABSTRACT

In an air/fuel ratio control system for an internal combustion engine, having a second air/fuel ratio sensor disposed downstream of a catalytic converter, a computing type used for computing a second air/fuel ratio correction quantity in accordance with an output of the second air/fuel ratio sensor is switched in such a manner that the second air/fuel ratio quantity is set larger when the output of the second air/fuel ratio sensor is outside a reference level range than when the output of the second air/fuel ratio sensor is within the reference level range.

4 Claims, 7 Drawing Sheets

AIR/FUEL RATIO CONTROL SYSTEM FOR INTERNAL COMBUSTION ENGINE

BACKGROUND OF THE INVENTION

1. Field of the Invention

The present invention relates in general to an air/fuel ratio control system for an internal combustion engine and more particularly to a system for performing feedback control of an air/fuel ratio of a mixture to be supplied to the engine through detection of an air/fuel ratio of combusted mixture in two places, i.e., upstream and downstream of a catalytic converter to cope with a malfunction of an air/fuel ratio sensor upstream of the catalytic converter.

2. Description of the Prior Art

An example of a prior art air/fuel ratio control system for an internal combustion engine is disclosed in Japanese patent provisional publication No. 60-240840.

In the prior art air/fuel ratio control system, an engine intake air quantity Q and engine speed N are detected to compute a basic fuel supply quantity $T_p$ ($T_p$=K.Q/N where K is constant). The basic fuel supply quantity $T_P$ is subjected to correction in accordance with engine temperature, etc. and to feedback correction by using air/fuel ratio feedback correction coefficient (air/fuel ratio correction quantity) which is set in response to a signal from an air/fuel ratio sensor (oxygen sensor) for detecting an air/fuel ratio through detection of an oxygen content in exhaust gases. The basic fuel supply quantity $T_P$ is further subjected to correction by battery voltage, etc. to finally determine a fuel supply quantity $T_I$.

By outputting a pulse signal having a pulse width corresponding to the fuel supply quantity $T_I$, to a fuel injection valve at a predetermined timing, a predetermined quantity of fuel is supplied to the engine.

The feedback correction of the air/fuel ratio in response to the signal from the air/fuel ratio sensor is performed so that the air/fuel ratio becomes closer to a target air/fuel ratio (stoichiometric air/fuel ratio). This is because the conversion efficiency (purification efficiency) of the catalytic converter which is disposed in the exhaust system for oxidizing CO, HC (hydrocarbon) and reducing $NO_X$ contained in the exhaust gases for purification of same, is set so that the catalytic converter can operate most efficiently under an exhaust gas condition resulting when a mixture of the stoichiometric air/fuel ratio is combusted.

The electromotive force (output voltage) produced by the above described air/fuel ratio sensor has such a characteristic that it changes suddenly adjacent the stoichiometric air/fuel ratio. Thus, by the comparison of the output voltage $V_O$ and the reference voltage (slice level) SL, it is determined whether the air/fuel ratio of the mixture is rich or lean with respect to the stoichiometric air/fuel ratio (i.e., richer or leaner than the stoichiometric air/fuel ratio). In case the air/fuel ratio is, for example, lean (or rich), the feedback correction coefficient $\alpha$ to multiply the above described basic fuel supply quantity $T_P$ is increased (or decreased) by increasing (or decreasing) a large proportional constant P at the first time of change of the air/fuel ratio to lean (or rich) and then increasing (or decreasing) a predetermined integration constant I gradually for thereby performing correction of increasing (or decreasing) the fuel supply quantity $T_I$ and controlling so that the air/fuel ratio becomes closer to the stoichiometric air/fuel ratio.

In the above described ordinary air/fuel ratio feedback control system, one air/fuel ratio sensor is installed on an exhaust manifold at a location as close as possible to a collective manifold portion where manifold branches are collected, in order to make higher the responsiveness of the air/fuel ratio sensor. However, the temperature at the collective portion is so high that the characteristic of the air/fuel ratio sensor is liable to vary. Further, mixing of the exhaust gases emitted from the respective cylinders is insufficient, so it is difficult to detect the average air/fuel ratio of the combusted mixtures emitted from the respective cylinders. Therefore, the accuracy in detection of the air/fuel ratio is not sufficiently high, thus deteriorating the accuracy in air/fuel ratio control.

In view of the above problem, it has been proposed to arrange another air/fuel ratio sensor at a location downstream of the catalytic converter and perform feedback control of the air/fuel ratio in accordance with the detection values by two air/fuel ratio sensors as disclosed in Japanese patent provisional publication No. 58-48756.

The air/fuel ratio sensor on the downstream side is far distant from the combustion chamber so that its responsiveness is not sufficiently high. However, the air/fuel ratio sensor on the downstream side is less affected by the balance of the exhaust gas components (CO, HC, NOx, $CO_2$, etc.) and less exposed to the toxic components of the exhaust gases so that its characteristic is less variable. Further, for the reason of good mixing of the exhaust gases, the air/fuel ratio sensor on the downstream side enables detection of the average air/fuel ratio for all of the cylinders, i.e., more accurate and more stable detection as compared with that by the air/fuel ratio sensor on the upstream side.

Thus, a highly accurate air/fuel ratio control is performed by the combination of two air/fuel ratio feedback correction coefficients which are respectively set by computation similar to that described as above, based on detection values by two air/fuel ratio sensors or by compensating variations of the output characteristic of thee air/fuel ratio sensor on the upstream side by correcting the control constant (proportional part or integration part) of the air/fuel ratio feedback correction coefficient which is set by the air/fuel ratio sensor on the upstream side and the comparison voltage and the delay time of the output voltage of the air/fuel ratio sensor on the upstream side.

However, the air/fuel ratio control system using such two air/fuel ratio sensors encounters the following problems.

The conversion efficiency of the catalytic converter varies depending upon variations of the temperature. Particularly, variation of the conversion efficiency with respect to HC is large. This is because the oxygen storage ability of the catalytic converter varies largely in response to variations of the temperature. So, even if the air/fuel ratio of the upstream side exhaust gases flowing into the catalytic converter is unchanged, the oxygen storage ability of the catalytic converter at low temperature is insufficient to cause a lack of oxygen ($O_2$) for reaction with hydrocarbon (HC) and a lowered HC conversion efficiency, whereas at high temperature the oxygen storage ability becomes higher to enable to attain a high HC conversion efficiency, i.e., the conversion efficiency varies depending upon variations of the temperature.

In this instance, when the correction quantity according to the air/fuel ratio of the downstream side exhaust gases is set larger, the air/fuel ratio is detected to be rather richer since the HC content in the exhaust gases at low temperature is large, resulting in that the lean correction quantity for correction of the air/fuel ratio toward lean becomes larger and at high temperature the lean correction quantity becomes comparatively smaller. Accordingly, in case a learning control of the correction quantity is made, the lean correction quantity is increased at high temperature, thus increasing the amount of $NO_x$ emission. When it is tried to make a learning control at every temperatures, the catalytic converter is disposed adjacent the road surface so there occurs such a case that the catalytic converter is suddenly cooled due to a splash of water, etc. Thus, it is difficult to estimate the temperature by means of a logic or temperature sensor and a good learning cannot be expected.

Further, during constant running of the engine (during constant speed running of the vehicle), the components of the exhaust gases on the upstream side of the catalytic converter are nearly constant and the reaction of the catalytic converter is maintained in a stable condition, so the air/fuel ratio of the exhaust gases on the downstream side of the catalytic converter is maintained constantly adjacent the stoichiometric air/fuel ratio, However, due to the influence of small variations of the air/fuel ratio caused, though momentarily, by the air/fuel ratio feedback control based on the detection value of the air/fuel ratio sensor on the upstream side or the influence of lodgment and dislodgment of oxygen ($O_2$) stored in the catalytic converter by the oxygen storage effect, the output of the air/fuel ratio sensor on the downstream side causes a small hunting. Due to this hunting, each time when the output value exceeds the slice level, the correction of the proportional part, etc. based on the detection value by the air/fuel ratio sensor on the downstream side is switched toward increase or decrease of the air/fuel ratio, so there occurs such a case that the air/fuel ratio varies in timed relation to the above described hunting.

In this instance, if the correction quantity based on the detection value by the air/fuel ration sensor on the downstream side is sufficiently small, a variation of the air/fuel ratio can be small, but when the correction quantity is set large a variation of the air/fuel ratio becomes large.

In view of the above, when the correction quantity of the air/fuel ratio based on the detection value by the air/fuel ratio sensor on the downstream side is set small, a delay in the correction of the air/fuel ratio may be caused in case of occurrence of a sudden variation of the air/fuel ratio. Further, when a variation of the air/fuel ratio occurs in the reverse direction with respect to the correction quantity of the air/fuel ratio having been set before occurrence of the variation of the air/fuel ratio, the conversion efficiency of the catalytic converter becomes worse. Enumerated as an example of such a case are a case just after fuel cut, malfunction of the upstream side air/fuel ratio sensor (decrease of the rich side output voltage, etc.), malfunction of parts of a fuel line (fuel injection valve, airflow meter, etc.).

SUMMARY OF THE INVENTION

According to an aspect of the present invention, there is provided a novel and improved air/fuel ratio control system for an internal combustion engine having an exhaust passage and a catalytic converter provided to the exhaust passage, which comprises first air/fuel ratio detecting means provided to the exhaust passage at a location upstream of the catalytic converter for producing a variable output in accordance with a density of a particular exhaust gas component which is variable with variation of an air/fuel ratio, second air/fuel ratio detecting means provided to the exhaust passage at a location downstream of the catalytic converter for producing a variable output in accordance with a density of a particular exhaust gas component which is variable with variation of an air/fuel ratio, first air/fuel ratio correction quantity computing means for computing a first air/fuel ratio correction quantity in accordance with the output of the first air/fuel ratio detecting means, second air/fuel ratio correction quantity computing means for computing a second air/fuel ratio correction quantity for correcting the first air/fuel ratio correction quantity in accordance with the output of the second air/fuel ratio correction quantity computing means, final air/fuel ratio correction quantity computing means for computing a final air/fuel ratio correction quantity based on the first air/fuel ratio correction quantity and the second air/fuel ratio correction quantity, air/fuel ratio control quantity setting means for correcting and setting an air/fuel ratio control quantity based on the final air/fuel ratio correction quantity computed by the final air/fuel ratio correction quantity computing means, and computing type switching means for switching a computing type of the second air/fuel ratio correction quantity computing means in such a manner that the second air/fuel ratio correction quantity is set larger when the output of the second air/fuel ratio detecting means is outside a reference level range than when the output of the second air/fuel ratio detecting means is within the reference level range. With this structure, when the output value of the second air/fuel ratio detecting means is within the reference level range, it is decided that there is not caused any sudden change of air/fuel ratio but the air/fuel ratio is in a stable condition so the second air/fuel ratio correction quantity based on the output value of the second air/fuel ratio detecting means is set smaller. By this, variation of drivability of a vehicle and erroneous control due to hunting of downstream side air/fuel ratio can be prevented. On the other hand, when the output value of the second air/fuel ratio detecting means is outside the reference level range, it is decided that the air/fuel ratio is in a condition of being changed suddenly, the second air/fuel ratio correction quantity based on the output value of the second air/fuel ratio detecting means is set larger. By this, correction of air/fuel ratio can be performed with good responsiveness and the conversion efficiency of the catalytic converter can be maintained high.

According to another aspect of the present invention, the air/fuel ratio control system further comprises means for variably setting an air/fuel ratio rich side limit value of the reference level range in accordance with a temperature of the second air/fuel ratio detecting means. When an ordinary oxygen sensor is used as the second air/fuel ratio detecting means, the output value varies depending upon variation of the temperature of the sensor under a rich air/fuel ratio condition. With this structure, the air/fuel ratio rich side limit value of the reference level range can be variably set in accordance with the temperature of the oxygen sensor, whereby judgment on the stability of the downstream side air/fuel ratio can be made without being affected by variation of the temperature of the sensor and the accuracy in switching the second air/fuel ratio correction quantity setting can be improved.

According to a further aspect of the present invention, the computing type switching means computes the second air/fuel ratio correction quantity by integral control when the output of the second air/fuel ratio detecting means is within the reference level range and by proportional plus integral control when the output of the second air/fuel ratio detecting means is outside the reference level range. With this structure, the second air/fuel ratio correction quantity can be made smaller by integral control when the output value of the second air/fuel ratio detecting means is within the reference level range and larger when the output value of the second air/fuel ratio detecting means is outside the reference level range.

According to a further aspect of the present invention, the computing type switching means switches the computing type in such a manner that a gain of control constant is made larger when the output of the second air/fuel ratio detecting means is outside the reference level range than when the output of the second air/fuel ratio detecting means is within the reference level range. With this structure, by setting the gain of the control constant larger when the output value of the second air/fuel ratio detecting means is outside the reference level range than when the output value is within the reference level range, the second air/fuel ratio correction quantity can be made smaller when the output value is within the reference level range and larger when the output is within the reference level range.

The above structure is effective for solving the above noted problems inherent in the prior device.

It is accordingly an object of the present invention to provide a novel and improved air/fuel ratio control system for an internal combustion engine which can attain an improved exhaust emission control.

It is a further object of the present invention to provide a novel and improved air/fuel ratio control system of the above described character which can prevent variation of vehicle drivability due to variation of air/fuel ratio which is caused in an elongated period of usage by aged deterioration of constituent parts of the system.

It is a further object of the present invention to provide a novel and improved air/fuel ratio control system of the above described character which can prevent erroneous control due to hunting of downstream side air/fuel ratio.

It is a further object of the present invention to provide a novel and improved air/fuel ratio control system of the above described character which can attain an air/fuel ratio control which is improved in responsiveness.

DETAILED DESCRIPTION OF THE PREFERRED EMBODIMENTS

Figure 1:
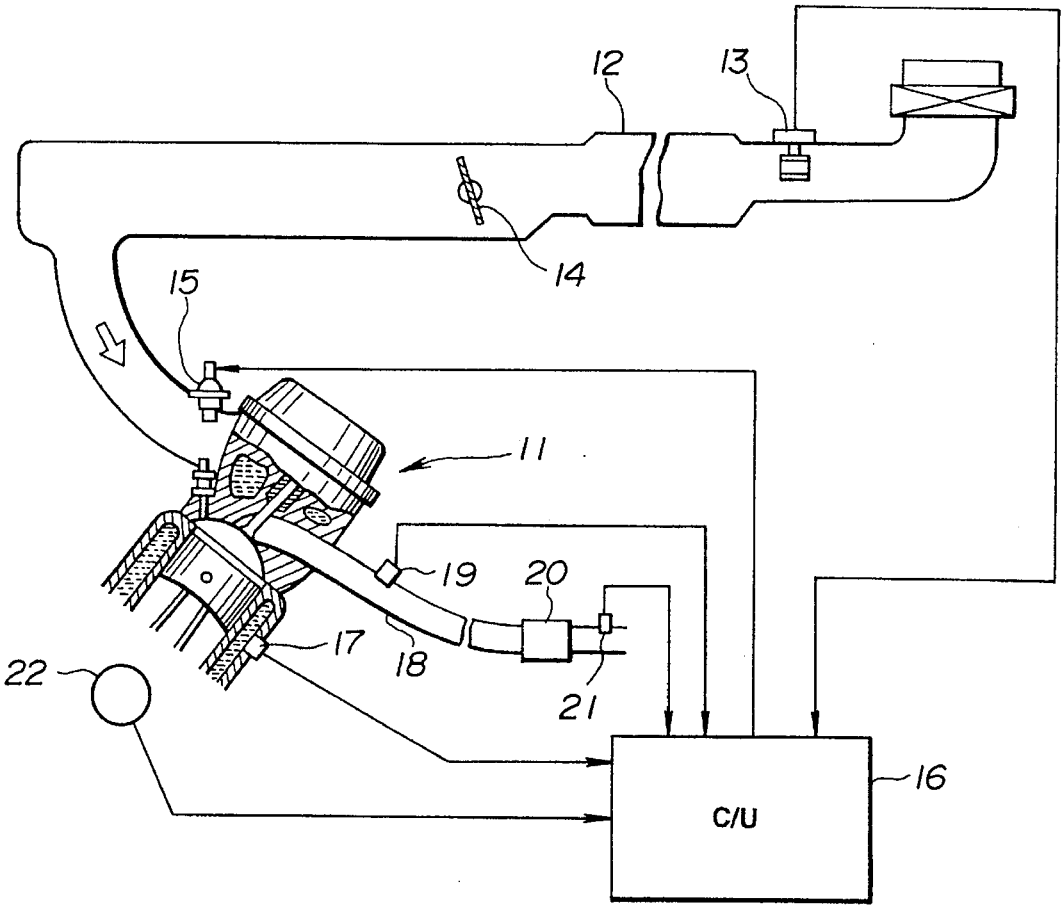
FIG. 1 is a schematic view of an air/fuel ratio control system according to an embodiment of the present invention.

Referring to FIG. 1, an internal combustion engine 11 has an intake passage 12 which is provided with an airflow meter 13 for detecting an intake air quantity Q and a throttle valve 14 movable in timed relation to an accelerator pedal (not shown) for controlling the intake air quantity Q. At a manifold portion downstream of the throttle valve 14, electromagnetic fuel injection valves 15 for each cylinders are provided, though only one is shown.

The fuel injection valve 15 is driven in response to an injection pulse signal from a control unit 16 having incorporated therein a microcomputer and injects fuel having been conducted thereto by pressure from a fuel pump and regulated to a predetermined pressure by means of a pressure regulator, for supply to each cylinder. Further, a coolant temperature sensor 17 is provided for detecting the temperature $T_w$ of coolant within a water jacket of the engine 11. On the other hand, an exhaust passage 18 is provided at a manifold collective portion thereof with a first air/fuel ratio sensor (first air/fuel ratio detecting means) 19 for detecting an oxygen content in the exhaust gases and thereby detecting an air/fuel ratio of a mixture supplied to the engine 11. The exhaust passage 18 is provided at a location downstream of the first air/fuel ratio sensor 19 with a three-way catalytic converter 20 for oxidizing CO, HC and reducing $NO_X$ contained in the exhaust gases for thereby purifying the exhaust emission from the engine 11. Further, the exhaust passage 18 is provided at a location downstream of the three-way catalytic converter 20 with a second air/fuel ratio sensor (second air/fuel ratio detecting means) 21 having the same function as the first air/fuel ratio sensor 19.

Further, a crank angle sensor 22 is incorporated in a distributor (not shown) so that engine speed N is detected by counting for a predetermined time a crank unit angle signal outputted by the crank angle sensor 22 in timed relation to revolution of the engine 11 or by measuring a cycle of a crank reference angle signal outputted by the crank angle sensor 22.

Figure 2:
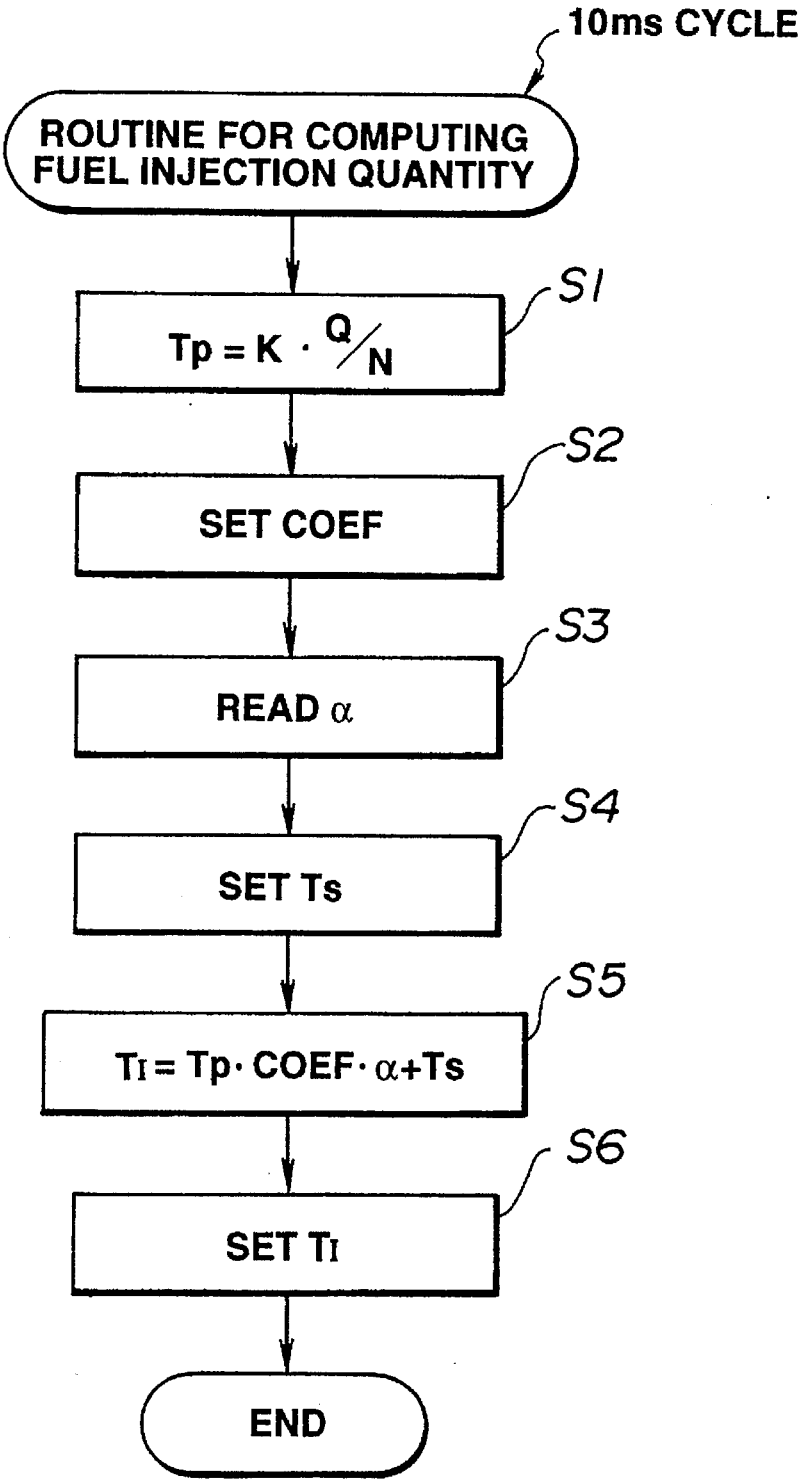
FIG. 2 is a flowchart for illustration of a routine for setting a fuel injection quantity in the air/fuel ratio control system of FIG. 1.
Figure 3:
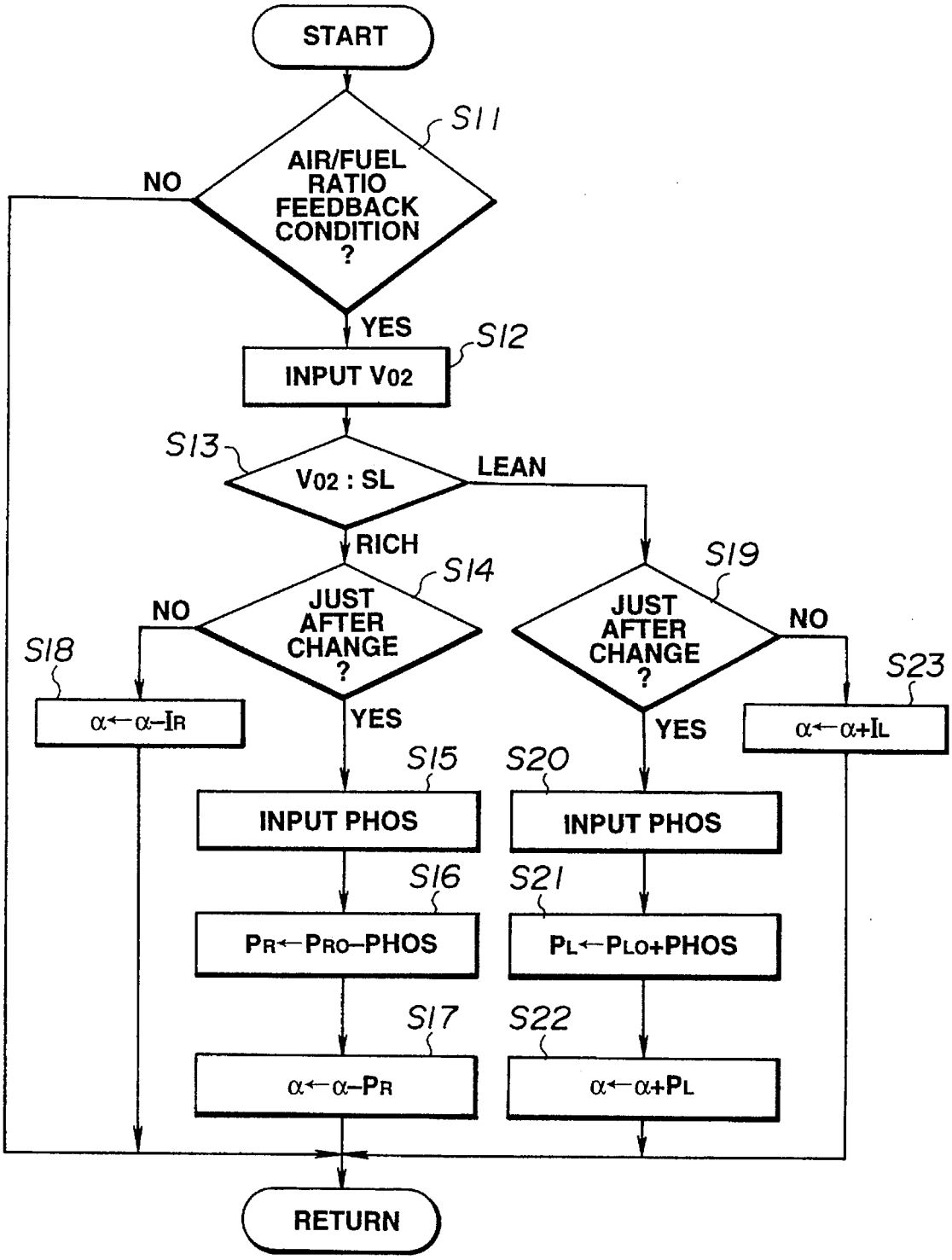
FIG. 3 is a flowchart for illustration of a routine for setting an air/fuel ratio feedback correction coefficient in the air/fuel ratio control system of FIG. 1.

Then, an air/fuel ratio control routine by means of the control unit 16 will be described with reference to FIGS. 2 and 3. FIG. 2 shows a fuel injection quantity setting routine and this routine is performed in a predetermined cycle (for example, about 10 msec).

In step S1, a basic fuel injection amount $T_P$ corresponding to an intake air quantity Q for a unit revolution computed using the following expression on the basis of the intake air quantity Q detected by the airflow meter 13 and the engine speed N computed based on the signal from the crank angle sensor 22. The function of the step S1 corresponds to a basic fuel supply quantity setting means.

$$T_P = K \times Q/N$$

where K is constant.

In step S2, various correction coefficients COEF are set based on a coolant temperature $T_W$ detected by the coolant temperature sensor 17, etc.

In step S3, a feedback correction coefficient $\alpha$ having been set by a feedback correction coefficient routine which will be described hereinlater is read.

In step S4, a voltage correction part $T_S$ is set based on battery voltage. This is done for correcting variation in the injection quantity of the fuel injection valve 15 due to variation of battery voltage.

In step S5, a final fuel injection quantity $T_I$ is computed using the following expression.

$$T_I = T_P \times COEF \times \alpha + T_s$$

Since a fuel injection quantity $T_I$ corresponds to an air/fuel ratio control quantity, the function of the steps S1~S5 corresponds to an air/fuel ratio control quantity setting means.

In step S6, the computed fuel injection quantity $T_I$ is set in an output register. By this, when it is time for fuel injection in timed relation to engine revolution, a drive pulse signal having a pulse width corresponding to the fuel injection quantity $T_I$ is given to the fuel injection valve 15 so that fuel injection is performed.

Then, an air/fuel ratio feedback correction coefficient setting routine will be described with reference to FIG. 3. This routine is exercised in timed relation to engine revolution.

In step S11, it is determined whether it is a driving condition in which an air/fuel ratio feedback control is to be performed. When the driving condition is not satisfied, this routine is finished. In this instance, the feedback correction coefficient α is clamped to a value at the time of finish of the previous feedback control or to a constant reference value, and the feedback control is stopped.

In step S12, a signal voltage $V_{02}$ from the first air/fuel ratio sensor 19 is inputted.

In step S13, it is judged whether the air/fuel ratio is rich or lean by comparing the signal voltage $V_{02}$ inputted in the step S12 with a reference value SL corresponding to a target air/fuel ratio (stoichiometric air/fuel ratio).

When the air/fuel ratio is judged to be rich, the control proceeds to step S14 where it is judged whether it is the time just after a change of the air/fuel ratio from lean to rich.

When it is judged that it is the time just after the change, the control proceeds to step S15 and a second air/fuel ratio correction quantity PHOS is inputted.

Then, the control proceeds to step S16 where a proportional part $P_R$ for decrease of air/fuel ratio, which is given at the time of a change of the air/fuel ratio to rich for setting an air/fuel ratio correction coefficient α, is updated to a value which is obtained by subtracting the above described second air/fuel ratio correction quantity PHOS from the reference value $P_{RO}$. Thereafter, in step S17, the air/fuel ratio feedback correction coefficient α is updated to a value which is obtained by subtracting the above described proportional part $P_R$ from the present value.

Further, when it is judged in step 14 that it is not the time just after the output of the air/fuel ratio sensor 19 is changed from lean to rich, the control proceeds to step S18 where the air/fuel ratio feedback control coefficient α is updated to a value which is obtained by subtracting an integral part $I_R$ from the present value.

On the other hand, when it is judged in the step S13 that the air/fuel ratio is lean, it is similarly judged in step S19 whether it is the time just after a change of the air/fuel ratio from rich to lean. When it is the time just after the change, the control proceeds to step S20 where the second air/fuel ratio correction quantity PHOS is inputted. Then, in step S21, a proportional part $P_L$ for increase of air/fuel ratio, which is given at the time of a change of the air/fuel ratio to lean for setting the air/fuel ratio feedback correction α, is updated to a value which is obtained by adding the above described second air/fuel ratio correction quantity PHOS to a reference value $P_{LO}$. Thereafter, in step S22, the air/fuel ratio feedback control correction on coefficient α is updated to a value which is obtained by adding the above described proportional portion $P_L$ to the present value. Further, when it is judged in step 19 that it is not the time just after the change, the control proceeds to the step S23 where the air/fuel ratio feedback correction coefficient α is updated to a value which is obtained by adding the integral part $I_L$ to the present value.

In the meantime, in this routine, it is considered that the air/fuel ratio feedback correction coefficient α is set by correcting the first air/fuel ratio correction quantity which is set based on the signal from the first air/fuel ratio sensor 19, using the proportional part reference values $P_{RO}$, $P_{LO}$ and the integral parts $I_R$, $I_L$, so this routine can function as both of a first air/fuel ratio correction quantity computing means and a final air/fuel ratio correction quantity computing means.

Figure 4:
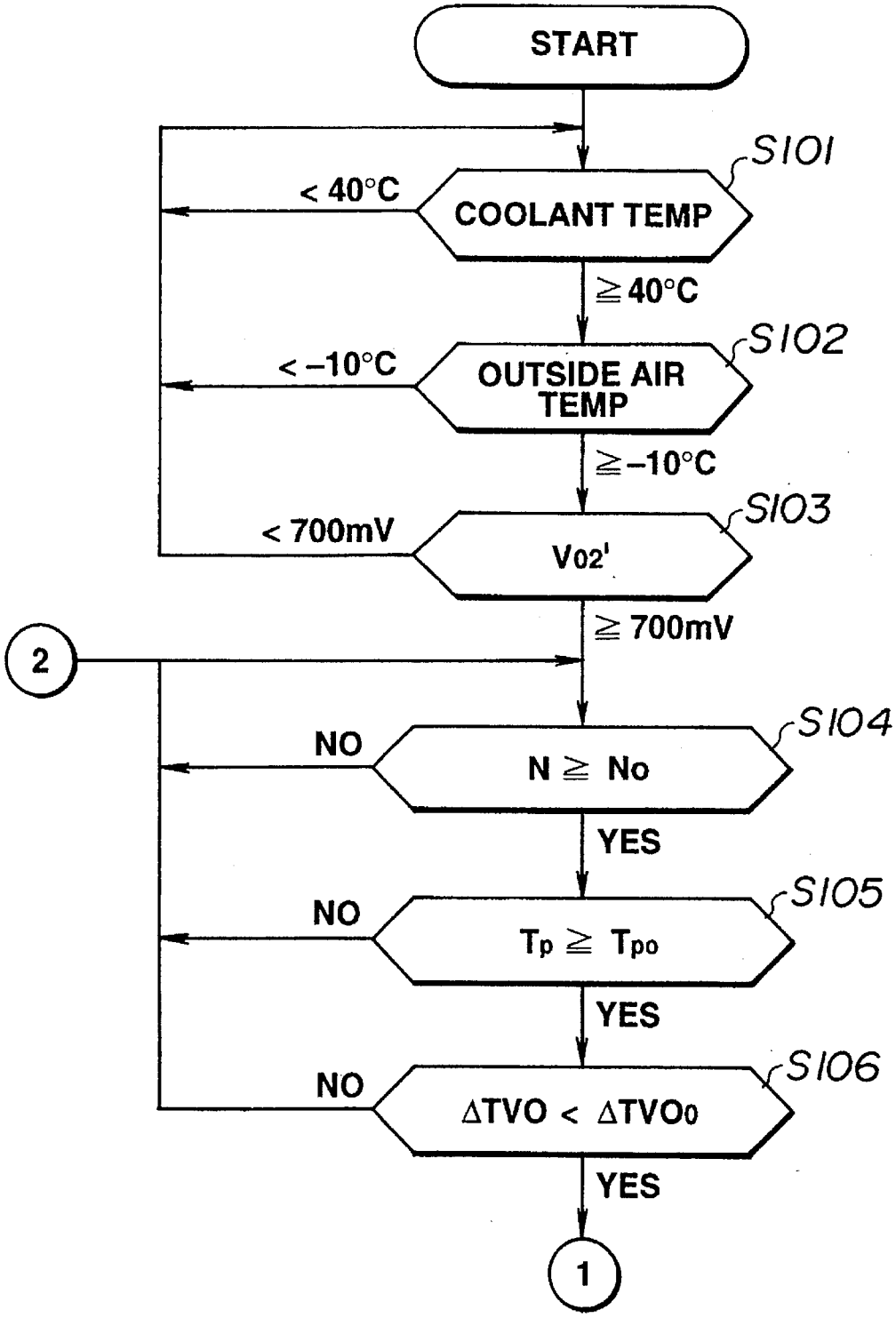
FIG. 4 is a flowchart for illustration of a preceding part of a routine for switching a computing type for a second:air/fuel ratio correction quantity.
Figure 5:
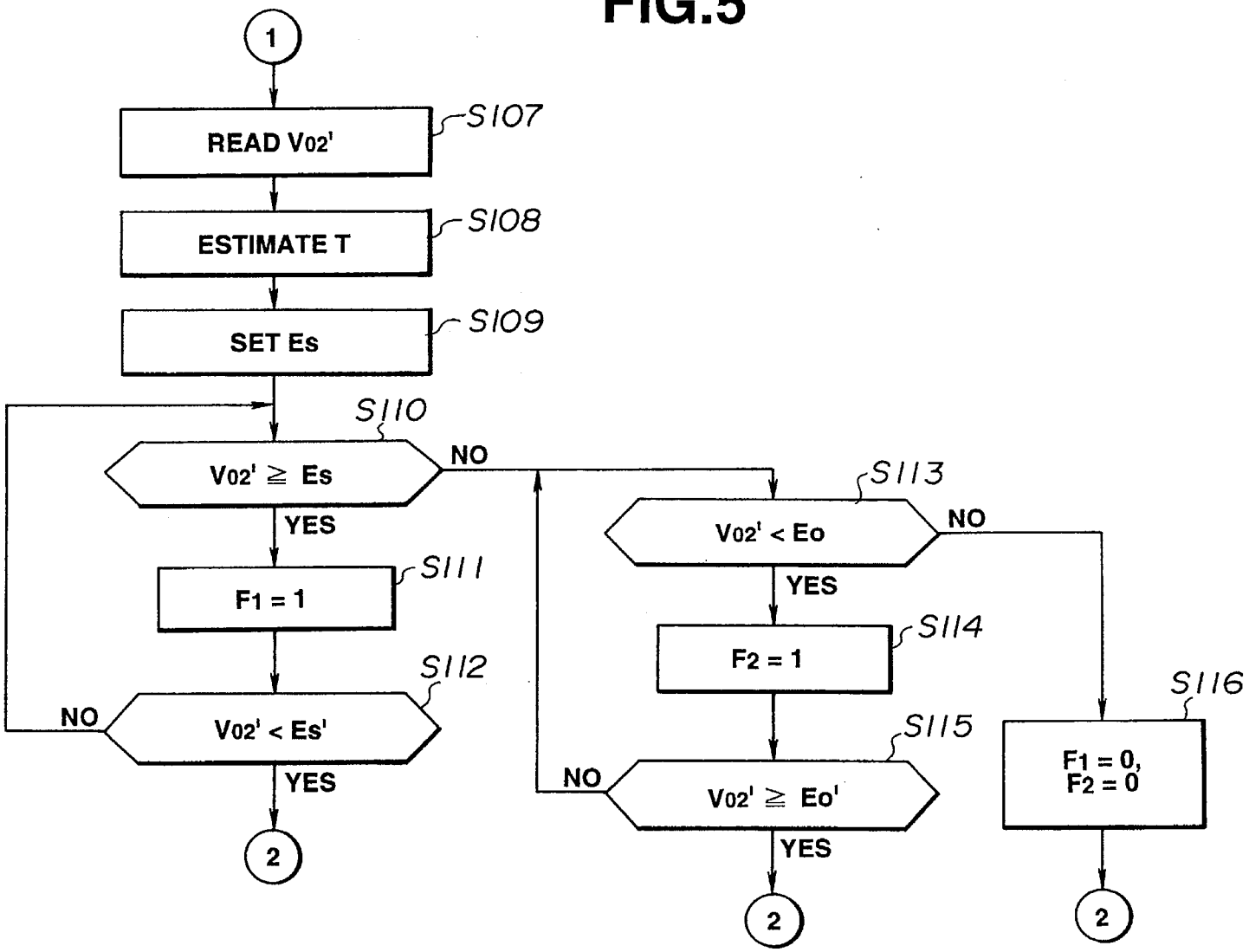
FIG. 5 is a flowchart for illustration of a succeeding part of the routine of FIG. 4.
Figure 6:
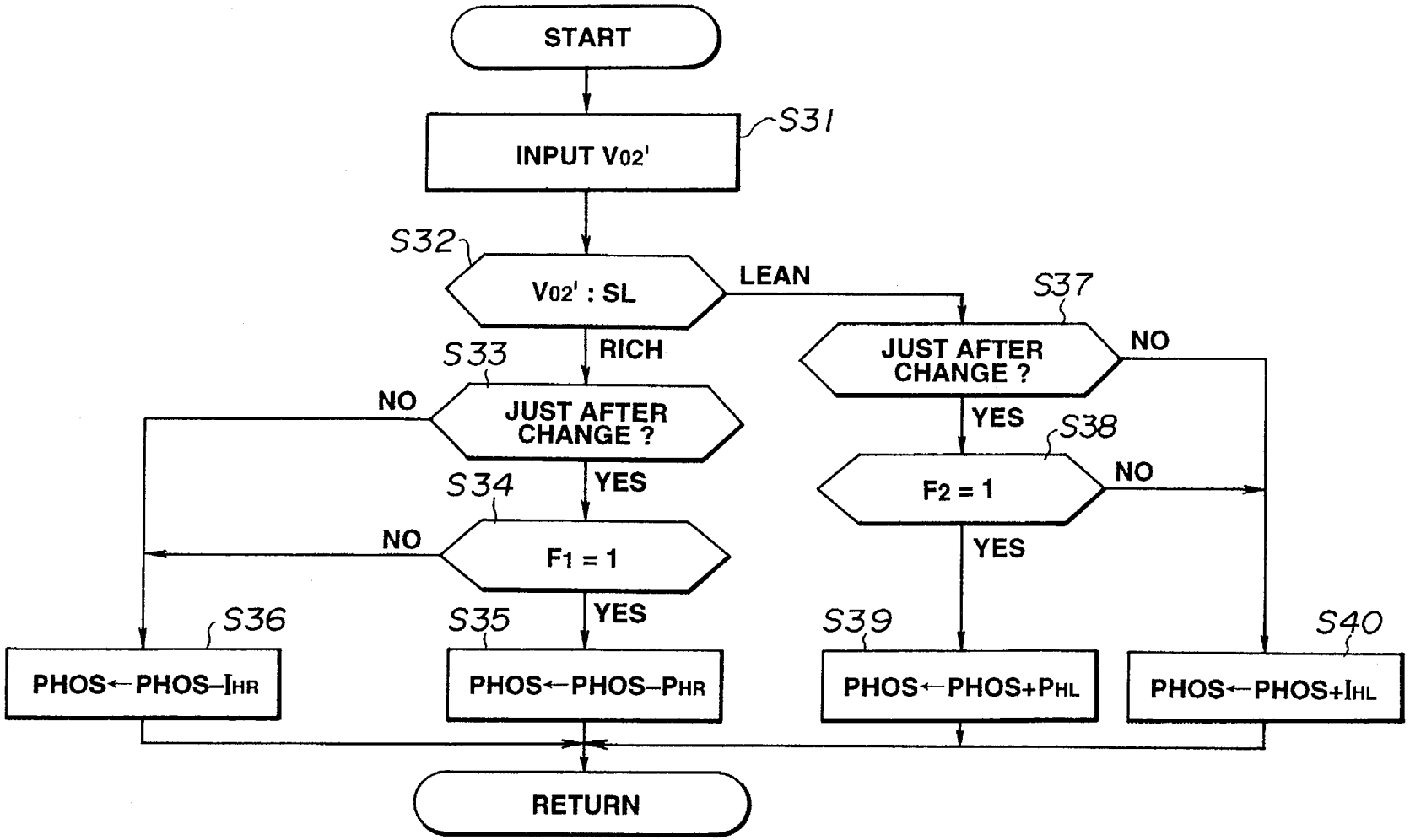
FIG. 6 is a flowchart for illustration of a routine for setting a second air/fuel ratio correction quantity.

Then, the routine for switching and setting a computing type for the second air/fuel ratio correction quantity PHOS will be described with reference to FIGS. 4 and 5. This routine is started at the same time when the engine is started.

In step S101, it is judged whether the coolant temperature is equal to or higher than a predetermined temperature (for example, 40° C.). In step S102, it is judged whether the outside air temperature is equal to or higher than a predetermined temperature (for example, −10° C.). In step S103, it is judged whether the output of the second air/fuel ratio sensor 21 is equal to or higher than a predetermined value (for example, 700 mV).

At engine starting, the air/fuel ratio is in a condition of being excessively rich due to the influence of increased fuel quantity for starting. For this reason, whether the second air/fuel ratio sensor 21 has become active or not can be judged by reference to the output level when the air/fuel ratio is rich. However, at excessively low temperature the active condition of the catalytic converter 20 is unstable. So, in order that the air/fuel ratio correction based on the output value of the second air/fuel ratio sensor 21 is prevented at excessively low temperature, the judgment on the activity of the catalytic converter 20 is made only when the coolant temperature and the outside air temperature are equal to or higher than predetermined temperatures, by comparing the output value of the second air/fuel ratio sensor 21 with a reference level when the air/fuel ratio is rich.

When the conditions of the above described steps S101, S102 and S103 are all satisfied, that is, when it is judged that the second air/fuel ratio sensor 21 is activated, the control proceeds to the step S104 onward.

In step S104, it is judged whether the engine speed N is equal to or higher than a predetermined speed $N_0$. In step S105, it is judged whether the basic fuel injection quantity $T_P$ is equal to or higher than a predetermined value $T_{PO}$. In step S106, it is judged whether the variation of the throttle valve opening degree ΔTVO is equal to or lower than a predetermined value $\Delta TVO_O$.

At low engine speed such as idling and at low load, the performance of the catalytic converter 20 is unstable, and further at such a transitional time of variation of an engine operating condition exceeding a predetermined degree, variation of the air/fuel ratio is so large. For this reason, it is concluded that a bad influence is exerted to the air/fuel ratio control if the air/fuel ratio correction is made based on the second air/fuel ratio sensor, and judgment on the above described prohibiting conditions is made.

When all of the conditions of the above described steps S104, S105 and S106 are satisfied, that is, when none of the prohibiting conditions is established, it is permitted to perform air/fuel ratio correction based on the output value of the second air/fuel ratio sensor, and the control proceeds to the step S107 where the computing type for air/fuel ratio correction is switched.

Firstly, in step S107, the output value $V_{02}'$ is read. In step S108, the temperature condition T of the second air/fuel ratio sensor 21 is estimated. The estimation can be made by directly detecting the temperature of an element of the sensor or otherwise can be made by reference to the exhaust temperature, engine speed or engine load.

In step S109, an air/fuel ratio rich side limit value $E_s$ within a reference level range for comparison with the above described output value is obtained by retrieval or the like from a map in accordance with the temperature T of the second air/fuel ratio sensor 21 which is estimated in the above described step S108. In this instance, in accordance with the temperature characteristic of the rich output of the second air/fuel ratio sensor 21, the limit value is set so as to become larger the lower the temperature becomes (for example, 800 mV at 350° C. or less) and become smaller the higher the temperature becomes (for example, 750 mV at 650° C. or larger).

In step S110, the output value $V_{02}'$ of the above described second air/fuel ratio sensor 21 is compared with the above described rich side limit value $E_s$.

When it is decided that $V_{02}' \geqq Es$, it is judged that the air/fuel ratio is fixedly held on the rich side due to a malfunction of the first air/fuel ratio sensor 19, fuel injection valve, airflow meter or the like, and in step S111 the flag F1 is set to 1 with a view to employing, in the calculation of the second air/fuel ratio correction quantity PHOS which will be described hereinlater, a computing type by proportional plus integral control for providing a proportional part $P_{HR}$ for correction of air/fuel ratio toward lean.

Thereafter, in step S112, the output value $V_{02}'$ of the second air/fuel ratio is read again and compared with a predetermined value $E_s'$ which is set to be smaller than the above described rich side limit value Es, so that when $V_{02}<E_s'$ it is judged that by the correction of the air/fuel ratio toward lean by giving the above described proportional part it is judged that the present air/fuel ratio has been caught up with and the control returns to the step S104.

Further, in case of judgment that in the above described step S109 the output value of the second air/fuel ratio sensor has not yet reached the rich side limit value, the control proceeds to the step S113 to make a comparison with the lean side limit value $E_0$ (for example, 10 mV).

When it is decided that $V_{02}'<E_0$, it is judged that the air/fuel ratio is fixedly held on the lean side due to a malfunction of the first air/fuel ratio sensor 19, fuel injection valve, airflow meter, or the like, and in the step S114 the flag $F_2$ is set to 1 with a view to employing, in the computation of the second air/fuel ratio correction PHOS which will be described hereinlater, the computing type by the proportional plus integral control for providing a proportional part $P_{HL}$ for correction of air/fuel ratio toward rich.

Thereafter, in step S115, the output value $V_{02}'$of the second air/fuel ratio sensor 21 is read again and is compared with a predetermined value $E_0$ ' (for example, 300 mV) which is set so as to be larger than the above described lean side limit value $E_0$. In this instance, when $V_{02}' \geqq E_0'$, it is judged that by the correction of air/fuel ratio toward rich by giving the proportional part the present air/fuel ratio has been caught up with, so that the control proceeds to the step S104.

Further, in case it is determined that the output value of the air/fuel ratio sensor has not yet reached to the lean side limit value, it is judged that the output value is within the reference level range and the air/fuel ratio is in a stable condition, so that neither of a proportional part for correction of air/fuel ratio toward rich or for lean is given and the flag is set to 0 in step S116 so as to employ a computing type by integral control.

Figure 7:
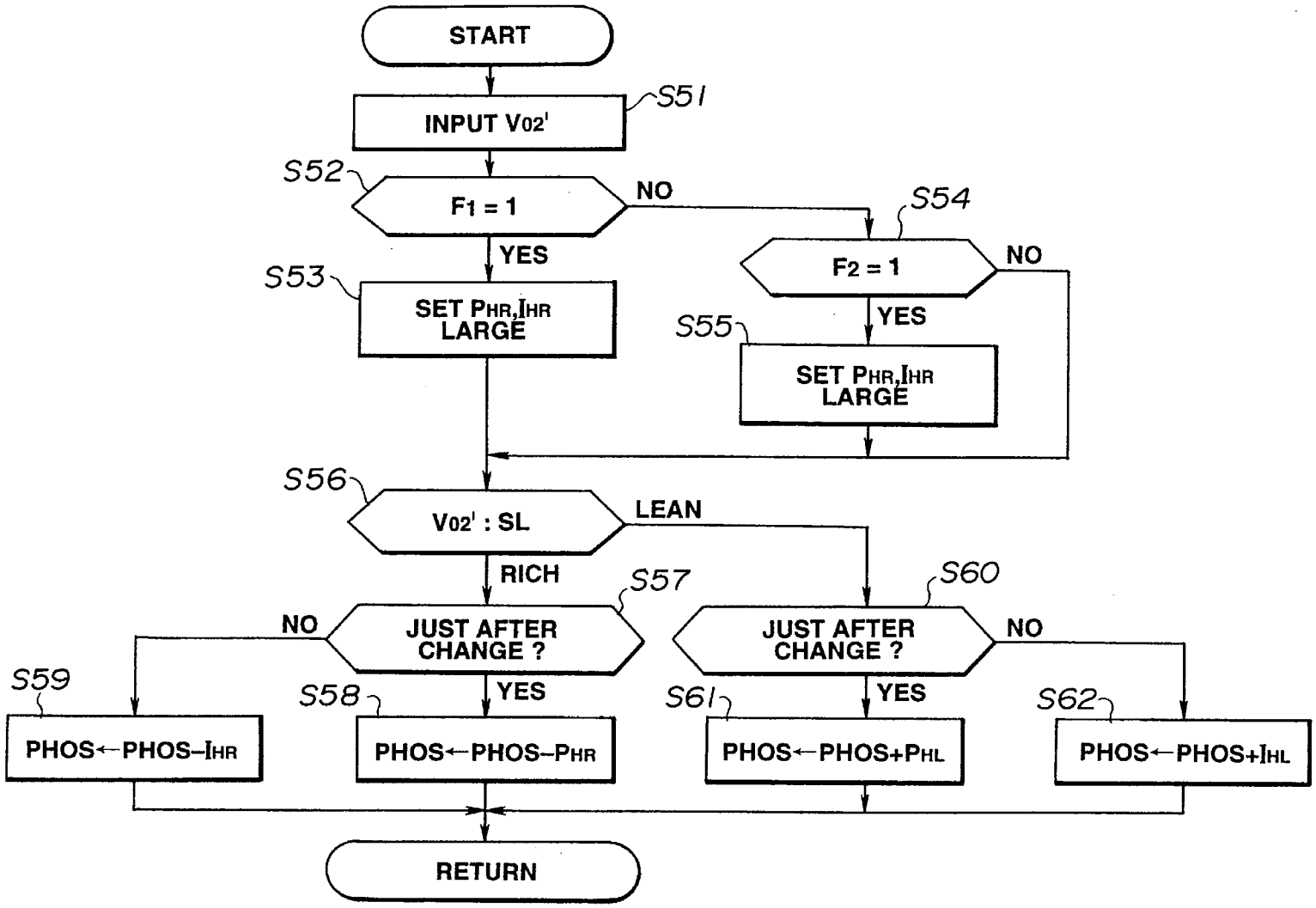
FIG. 7 is a flowchart for illustration of a routine for setting a second air/fuel ratio according to a variant of the present invention.

Then, referring to FIG. 7, a routine for setting a second air/fuel ratio Correction quantity PHOS based on the signal of the second air/fuel ratio sensor whilst performing the above described switching of the computing type will be described. This routine is performed in a predetermined cycle.

In step S31, the output voltage $V_{02}'$ of the second air/fuel ratio sensor is inputted.

In step S32, it is judged whether the air/fuel ratio is lean or rich by comparing the above described output voltage $V_{02}'$ and a reference value SL equated to a target air/fuel ratio stoichiometric air/fuel ratio).

When the air/fuel ratio is judged to be rich, the control proceeds to the step S33 where judgment is made on whether it is the time just after a change of the air/fuel ratio from lean to rich.

When it is decided that it is the time just after the change, the control proceeds to the step S34 where the value of the flag $F_1$ is read. When the flag has been set to 1, the control proceeds to the step S35 where the air/fuel ratio correction quantity PHOS is updated to a value which is obtained by subtracting a proportional part $P_{HR}$ from the previously set quantity. Further, when the value of the above described flag F1 is 0 and when it is decided in step S36 that it is not the time just after the change, the air/fuel ratio correction quantity PHOS is updated in step S35 to a value which is obtained by subtracting a predetermined integral part $I_{HR}$ from the previously set value.

On the other hand, when it is decided in step S32 that the air/fuel ratio is lean, the control proceeds to the step S37 where judgment is made on whether it is the time just after a change of the air/fuel ratio from rich to lean.

When it is decided that it is the time just after the change, the value,of the flag $F_2$ is read in step S38. When the value of the flag $F_2$ is set to 1, the control proceeds to step S39 where the second air/fuel ratio correction quantity PHOS is updated to a value which is obtained by adding a predetermined proportional part $P_{HL}$ to the previously set air/fuel ratio correction quantity. Further, when it is decided that the value of the flag F2 is 0 and it is decided in step S37 that it is not the time just after the change, the control proceeds to step S40 where the second air/fuel ratio correction quantity PHOS is updated to a value which is obtained by adding a predetermined integral portion $I_{HL}$ to the previously set correction quantity.

In the manner described as above, by setting to small in a stable air/fuel ratio condition by means of integral control, the second air/fuel ratio control quantity which is set through detection of the air/fuel ratio on the downstream side of the catalytic converter, it becomes possible to prevent variation of engine operation and erroneous control due to hunting of the downstream side air/fuel ratio. On the other hand, in regard to a sudden air/fuel ratio change, the second air/fuel ratio correction quantity is set to large by giving a proportion part for prevention of such a change, whereby air/fuel ratio correction can be performed with good responsiveness and the conversion efficiency of the catalytic converter can be maintained high.

FIG. 8 shows another switching of a computing type. In step S51, the output of the second air/fuel ratio sensor 21 is read. Then, in step S52, judgment is made on the value of the flag $F_1$. In case the value of the flag $F_1$ is 1, the control proceeds to step S53 where a proportional pare $P_{HR}$ and an integral part $I_{HR}$ for correction of air/fuel ratio toward lean are set large. In case the value of the flag $F_1$ is 0, the control proceeds to step S54 where judgment is made on the value of the flag $F_2$. When the value of the flag $F_2$ is 1, the control proceeds to step S55 where the proportional part $P_{HL}$ and the integral part $I_{HR}$ for correction of air/fuel ration toward rich are set large.

Further, when both of the values of the flags F1 and F2 are 0, the proportional part $P_{HR}$ and the integral part $I_{HR}$ for correction of air/fuel ration toward lean and the proportional part $P_{HL}$ and the integral part $I_{HL}$ for correction of air/fuel ratio toward rich are both set to an ordinary value.

From this step onward, in steps S56~S62 the second air/fuel ratio correction quantity is set by proportional plus integral control based on the output value of the second air/fuel ratio sensor 21.

In this embodiment, in case a variation of air/fuel ratio is large, the gains of the proportional part and the integral part in the direction to prevent the variation are set large, whereby the same effect as the first embodiment can be obtained.

From the foregoing, it will be understood that according to the present invention, in case the air/fuel ratio is in a stable condition, the second air/fuel ratio correction quantity based on the output value of the second air/fuel ratio sensor on the downstream side of the catalytic converter is set large whereby variation of engine performance and erroneous control due to hunting of the downstream side air/fuel ratio can be prevented, whereas in case of sudden variation of the air/fuel ratio due to a malfunction of a constituent part or the like, the second air/fuel ratio correction quantity is see large whereby the air/fuel ratio correction can be made with good follow-up or responsiveness and the conversion efficiency of the catalytic converter can be maintained high.

It will be further understood that according to the present invention rich side air/fuel ratio limit value within the reference level range which is compared with the output value of the second air/fuel ratio sensor for switching the above described second air/fuel ratio correction quantity is variably set in accordance with the temperature,whereby judgment on the stability of the downstream side air/fuel ratio can be made without being affected by the temperature and the switching accuracy in the switching of the second air/fuel ratio correction quantity setting can be improved.

It will be further understood that according to the present invention the second air/fuel ratio correction quantity can be made smaller by integral control when the output of the second air/fuel ratio is within the reference level range and can be made larger by proportional plus integral control when the output value of the second air/fuel ratio sensor is outside the reference level range.

It will be further understood that according to the present invention the gain of the control constant, when the output value of the second air/fuel ratio detecting means is outside the reference level range, can be made larger as compared with that when the output value is within the reference level range, whereby the second air/fuel ratio correction quantity can be made smaller when the output is within the range and larger when the output is outside the range.

What is claimed is:

1. An air/fuel ratio control system for an internal combustion engine having an exhaust passage and a catalytic converter provided to the exhaust passage, comprising:

first air/fuel ratio detecting means provided to the exhaust passage at a location upstream of the catalytic converter for producing a variable output in accordance with a density of a particular exhaust gas component which is variable with variation of an air/fuel ratio;

second air/fuel ratio detecting means provided to the exhaust passage at a location downstream of the catalytic converter for producing a variable output in accordance with a density of a particular exhaust gas component which is variable with variation of an air/fuel ratio;

first air/fuel ratio correction quantity computing means for computing a first air/fuel ratio correction quantity in accordance with the output of said first air/fuel ratio detecting means;

second air/fuel ratio correction quantity computing means for computing a second air/fuel ratio correction quantity for correcting said first air/fuel ratio correction quantity in accordance with the output of said second air/fuel ratio detecting means;

final air/fuel ratio correction quantity computing means for computing a final air/fuel ratio correction quantity based on said first air/fuel ratio correction quantity and said second air/fuel ratio correction quantity;

air/fuel ratio control quantity setting means for correcting and setting an air/fuel ratio control quantity based on the final air/fuel ratio correction quantity computed by said final air/fuel ratio correction quantity computing means; and computing type switching means for switching a computing type of said second air/fuel ratio correction quantity computing means in such a manner that said second air/fuel ratio correction quantity is set larger when the output of said second air/fuel ratio detecting means is outside a reference level range than when the output of said second air/fuel ratio detecting means is within the reference level range.

2. An air/fuel ratio control system according to claim 1, further comprising means for variably setting an air/fuel ratio rich side limit value of said reference level range in accordance with a temperature of said second air/fuel ratio detecting means.

3. An air/fuel ratio control system according to claim 1, wherein said computing type switching means computes said second air/fuel ratio correction quantity by integral control when the output of said second air/fuel ratio detecting means is within said reference level range and by proportional plus integral control when the output of said second air/fuel ratio detecting means is outside said reference level range.

4. An air/fuel ratio control system according to claim 1, wherein said computing type switching means switches said computing type in such a manner that a gain of control constant is made larger when the output of said second air/fuel ratio detecting means is outside said reference level range than when the output of said second air/fuel ratio detecting means is within said reference level range.

* * * * *